United States Patent [19]

Inoue et al.

[11] Patent Number: 4,970,997

[45] Date of Patent: Nov. 20, 1990

[54] VALVE OPERATING MECHANISM FOR AN INTERNAL COMBUSTION ENGINE

[75] Inventors: Kazuo Inoue; Takashi Hanaoka; Tsuneo Konno, all of Saitama, Japan

[73] Assignee: Honda Giken Kogyo Kabushiki Kaisha, Tokyo, Japan

[21] Appl. No.: 477,196

[22] Filed: Feb. 5, 1990

Related U.S. Application Data

[60] Continuation of Ser. No. 305,550, Feb. 3, 1989, abandoned, which is a division of Ser. No. 39,111, Apr. 15, 1987, abandoned.

[30] Foreign Application Priority Data

| | | | |
|---|---|---|---|
| Apr. 16, 1986 | [JP] | Japan | 61-86072 |
| Jul. 4, 1986 | [JP] | Japan | 61-157488 |
| Oct. 13, 1986 | [JP] | Japan | 61-242675 |

[51] Int. Cl.[5] ..... F01L 1/00

[52] U.S. Cl. ..... 123/90.16; 123/90.66; 267/166

[58] Field of Search ..... 123/90.16, 90.65, 90.66, 123/188 SA, 188 SC, 90.17, 90.18; 267/166, 179, 180

[56] References Cited

U.S. PATENT DOCUMENTS

| | | | |
|---|---|---|---|
| 1,928,678 | 10/1933 | Sjolander | 123/90.66 |
| 2,789,550 | 4/1957 | Black | 123/90.66 |
| 4,077,619 | 3/1978 | Borlinghaus | 267/166 |
| 4,111,407 | 9/1978 | Stager | 267/166 |
| 4,120,489 | 10/1978 | Borlinghaus | 267/166 |
| 4,420,141 | 12/1983 | Goloff | 123/90.65 |
| 4,446,825 | 5/1984 | Giardini et al. | 123/90.65 |
| 4,538,563 | 9/1985 | Mayers | 267/166 |
| 4,545,342 | 10/1985 | Nakano et al. | 123/90.16 |
| 4,735,403 | 4/1988 | Matsumoto et al. | 267/166 |

FOREIGN PATENT DOCUMENTS

| | | | |
|---|---|---|---|
| 0217711 | 12/1983 | Japan | 123/90.65 |
| 0255203 | 11/1986 | Japan | 132/90.65 |

*Primary Examiner*—Andrew M. Dolinar
*Assistant Examiner*—M. Macy
*Attorney, Agent, or Firm*—Lyon & Lyon

[57] ABSTRACT

A valve operating mechanism for an internal combustion engine having a valve disposed in an intake port or an exhaust port of a combustion chamber and being openable by a rotatable cam and cam follower in synchronism with the engine crankshaft rotation. The valve is normally urged toward the closed position by a spring means encircling the valve. Various embodiments are disclosed for varying the resilient force urging the valve toward the closed position during different engine operating conditions, such as, increasing the resilient valve closing force during high-speed operation for ensuring proper valve operation and decreasing the resilient valve closing force during low-speed operation for reducing friction in the valve operating mechanism. The valve operating mechanism includes means for switching between actuation by a low-speed cam or a high-speed cam. One form of the spring means includes a mechanism for increasing the spring force on the high-speed cam follower only during high-speed operation. Another form of the spring means includes a valve spring having a non-uniform rate of compression for imposing a higher rate of increase of spring force as the valve is opened a larger amount at high-speed.

10 Claims, 8 Drawing Sheets

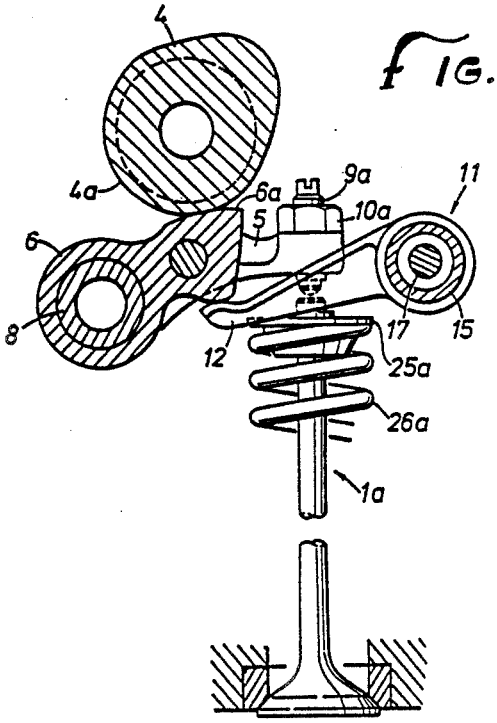
FIG. 2.
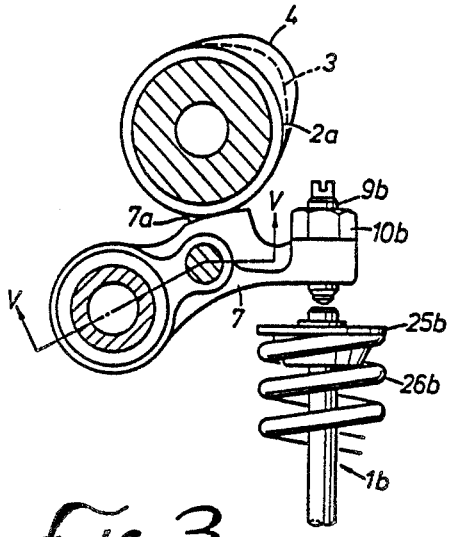
FIG. 3.
FIG. 5.
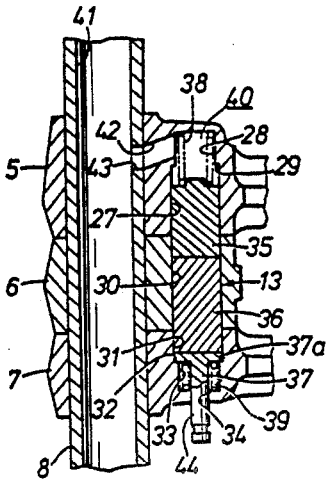
FIG. 6.
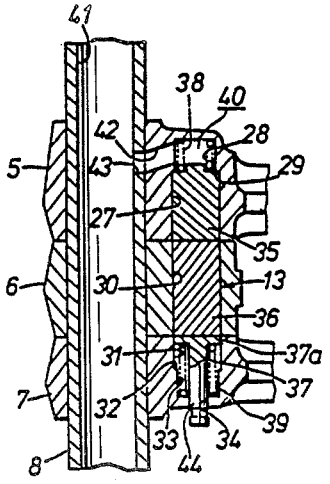

FIG. 13.
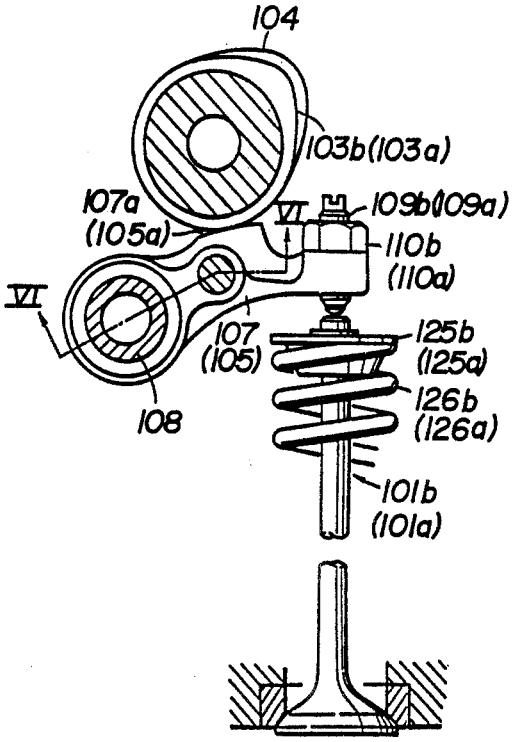
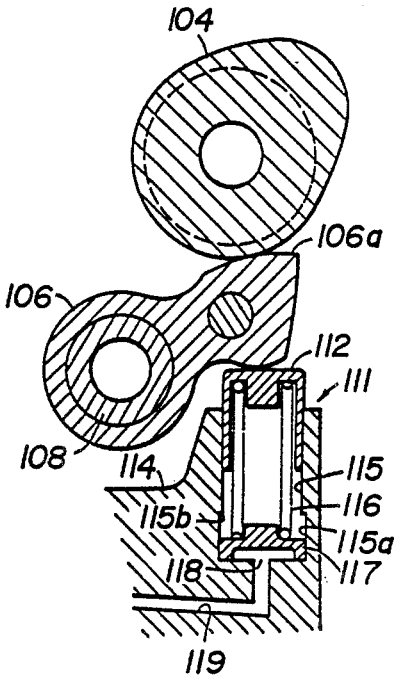
FIG. 12.
FIG. 14.
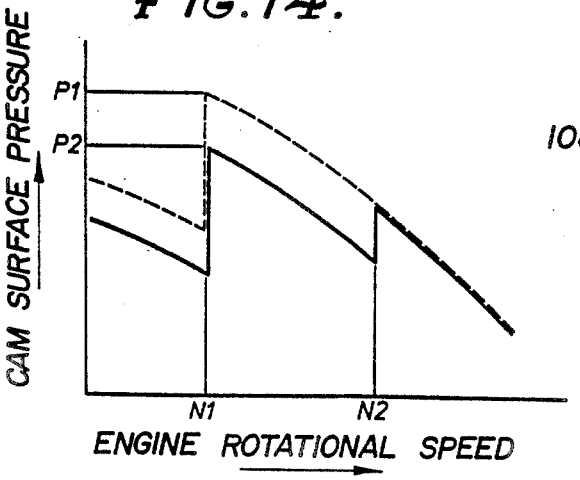
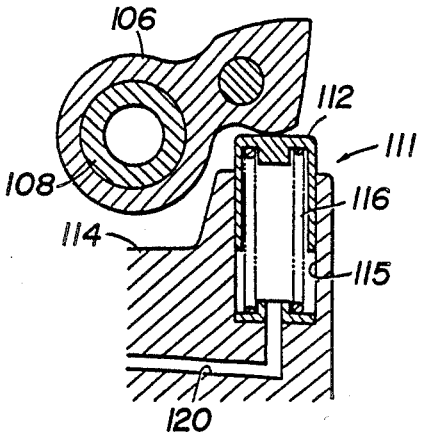
FIG. 15.

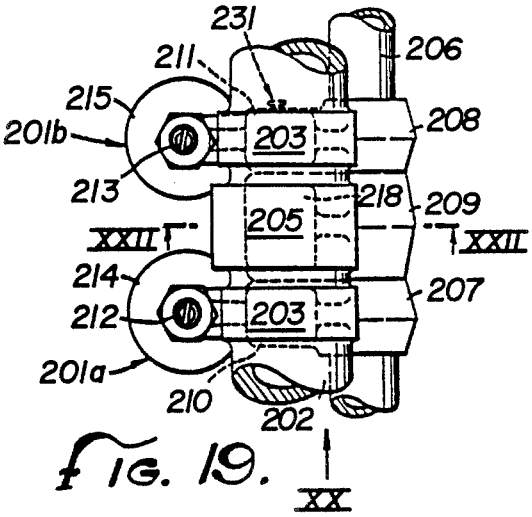
FIG. 19.
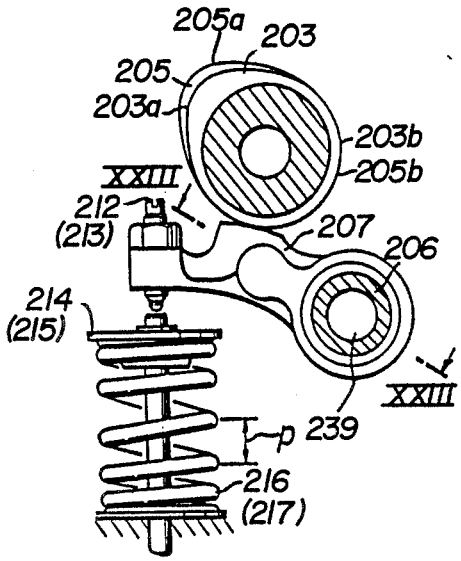
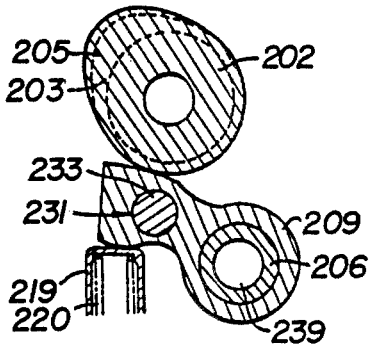
FIG. 22.
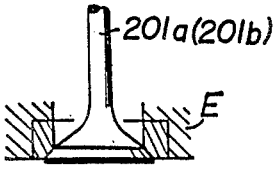
FIG. 20.
FIG. 21
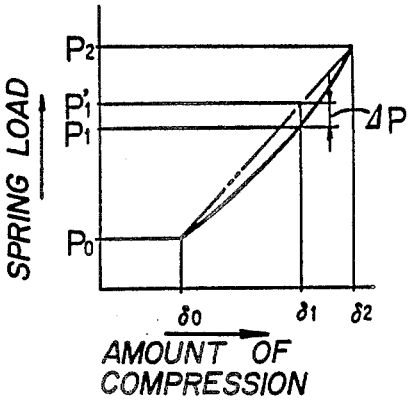

VALVE OPERATING MECHANISM FOR AN INTERNAL COMBUSTION ENGINE

This application is a continuation of application Ser. No. 305,550, filed Feb. 3, 1989, which is a division of application Ser. No. 039,111, filed Apr. 15, 1987, both abandoned.

The present invention relates to a valve operating mechanism for opening and closing an intake port or an exhaust port in synchronism with rotation of an internal combustion engine and, in particular, to a valve operating mechanism in which means are provided for varying the biasing force imposed on the valve in the valve closing direction.

The combustion chambers of a four-cycle engine have intake and exhaust valves for supplying an air-fuel mixture into and discharging a burned gas from the combustion chambers according to prescribed cycles. These intake and exhaust valves are normally urged in a closing direction by valve springs disposed around the valve stems, respectively. The intake and exhaust valves are forcibly opened against the bias of the valve springs by cams integrally formed on a camshaft which is driven by the crankshaft of the engine through a belt and pulleys. Therefore, if the biasing forces of the valve springs are excessively large, the friction loss is increased to an undesirable level, especially when the engine operates in low- and medium-speed ranges. However, if the biasing forces of the valve springs are selected to match the low- and medium-speed ranges, then the ability of the cam followers to continually follow the cams in high-speed ranges would be reduced, or the valves will suffer from abnormal vibration in overcoming the bias of the valve springs, because of the inertial forces of the valves themselves and the conventional valve operating system, such as rocker arms serving as the valve followers for transmitting the lift of the cams to the valve stems, with the result that the proper intake and exhaust valve, timing will be impaired.

In some internal combustion engine arrangements, a plurality of intake valves or exhaust valves are disposed in each cylinder during low-speed operation of the engine, only one intake valve and one exhaust valve is operated or more than one of each of the valves may be operated to open less than a full amount. During high-speed operation of the engine, all of the valves are operated. During medium-speed operation of such an engine, the number of valves that are opened and the magnitude of the opening may be selected to be intermediate of the operations at low and high speeds. Further, the operational timing of the valves may be varied dependent on the engine rotational speed. With such an arrangement, the efficiency with which the air-fuel mixture is charged into the combustion chamber can be increased over a wide range of operation.

It is conventional for valve operating devices of the type described above to employ valve springs having linear loading characteristics in which the spring load for returning the valve to the closed position is proportional to the amount of displacement of the valve from the closed position.

These characteristics of prior conventional valve operating mechanisms have numerous problems and inefficiencies to which the present invention is directed toward solving.

Automotive engines which vary in operational speed over a wide range have failed to meet the requirements for both a reduction in the friction in low- and medium-speed ranges and an increase in the ability of a valve operating system to follow the cams in a high-speed range. Japanese Utility Model Publication No. 60-30437 discloses an arrangement in which valve springs are compressed under hydraulic pressure to increase reactive forces from the valve springs in order to vary the biasing forces for opening valves. However, that system is directed to an exhaust brake, and may not necessarily be suitable for compensating for the inertial mass of a valve operating system in a high-speed range because the spring constants of the valve springs are not varied.

With a valve operating mechanism capable of selectively operating one or more valves for each cylinder for high-speed and low-speed operations, as described above, it is difficult to select proper valve springs to produce the desired biasing forces under all operating conditions. If the valve timing is varied and simultaneously the valve lift is increased, the pressure on the cam surface is increased and therefore suggesting that the sliding surfaces of the cams should be increased in width, which would cause an undesirable increase in the weight of the valve operating mechanism.

In view of the conventional problems described above, it is a primary object of the present invention to provide a valve operating mechanism for an internal combustion engine, which is capable of meeting the requirements both for a reduction in the friction in low- and medium-speed ranges and for an increase in the ability of the valve operating system to follow the cams in a high-speed range.

According to the present invention, the above object can be achieved by a valve operating mechanism for an internal combustion engine having a valve disposed in an intake port or an exhaust port of a combustion chamber and normally urged by spring means to be closed, the valve being openable by a cam rotatable in synchronism with a crankshaft, the valve operating mechanism including spring means for resiliently urging the valve operating mechanism with a biasing force in the closing direction of the valve with a greater biasing force when the engine is in a prescribed operating condition such as when the speed of rotation of the engine is higher than a prescribed value.

In one embodiment of the invention an auxiliary spring is provided and its operation controlled such that only the biasing forces of the valve springs on valve stems act on the valve operating mechanism in a low-speed range, and the biasing force of the auxiliary spring also acts on the valve operating mechanism in a high-speed range. Therefore, the biasing forces for opening the valves in an overall valve operating system can be switched between two stages according to the operating conditions of the engine such as different speed ranges.

In another embodiment of the present invention, the above objective can be accomplished by a valve operating mechanism which includes a fluid pressurizing device for acting directly or indirectly on the spring means for varying the reactive force of the spring means, whereby the reactive force may be increased during high-speed operation of the engine.

In still another embodiment of the present invention for accomplishing the above objects, the valve spring is non-linear whereby the rate of change of the spring load imposed on the valve is increased as the amount of valve opening increases which occurs in high-speed operation of the engine by reason of the valve operating mechanism.

The preferred embodiments of the present invention will be described in detail with reference to the accompanying drawings wherein:

FIG. 2 is a cross-sectional elevation view taken substantially on the line II—II of FIG. 1;

FIG. 3 is a cross-sectional elevation view as viewed in the direction of arrow III in FIG. 2;

FIG. 5 is a cross-sectional plan view taken substantially along the line V—V cf FIG. 3, showing a coupling mechanism during high-speed operation of the engine;

FIG. 6 is a cross-sectional plan view similar to FIG. 5, showing the coupling mechanism during low-speed operation;

FIG. 12 is a cross-sectional elevation view taken substantially along the line XII—XII of FIG. 11;

FIG. 13 is a cross-sectional elevation view taken in the direction of the arrow XIII in FIG. 11;

FIG. 14 is a graph showing variations in cam surface pressure during the operation of the embodiment illustrated in FIGS. 11–13;

FIG. 15 is a sectional elevation view similar to FIG. 12 and showing a modification of this fifth embodiment;

FIG. 19 is a plan view similar to FIGS. 1 and 11 and illustrating a further embodiment of the present invention;

FIG. 20 is a sectional elevation view taken in the direction of arrow XX in FIG. 19;

FIG. 21 is a graph showing the loading characteristics of a conventional valve spring and the valve springs of certain embodiments of the present invention;

FIG. 22 is a sectional elevation view taken substantially along the line XXII—XXII in FIG. 19;

In the following description of the various embodiments shown in the figures, the same numeral will be used to identify elements or portions of elements that are identical or virtually identical from one embodiment to another. In the embodiments of FIGS. 11–18, numerals in the 100 series will be used to identify identical or similar elements or portions of elements where appropriate. Similarly, in the embodiments of FIGS. 19–25, numerals in the 200 series will be used for the same or similar elements or portions of elements. The embodiments of FIGS. 1–10 will be described first.

Figure 1:
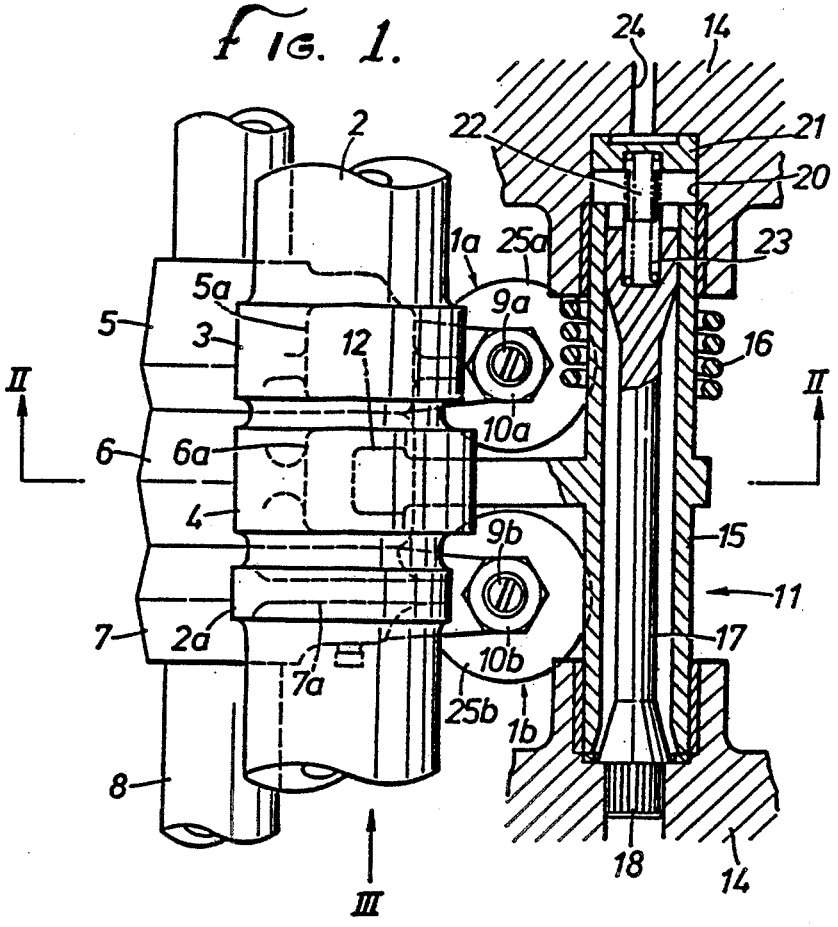
FIG. 1 is a plan view of a portion of a valve operating mechanism incorporating a loading device of the first embodiment of the present invention.

As shown in FIGS. 1 through 3, an engine body (not shown) has a pair of intake valves 1*a*, 1*b* which can be opened and closed by the coaction of low- and high-speed cams 3, 4 of an appropriate cross section integrally formed on a camshaft 2 synchronously rotatable at a speed ratio of ½ with respect to the speed of rotation of a crankshaft (not shown), with first through third rocker arms 5 through 7 serving as pivotable cam followers in engagement with the cams 3, 4. The engine also has a pair of exhaust valves (not shown) which are opened and closed in the same manner as the intake valves 1*a*, 1*b*.

The first through third rocker arms 5 through 7 are pivotally supported adjacent to each other on a rocker shaft 8 located below the camshaft 2 and extending parallel thereto. The first and third rocker arms 5, 7 are basically of the same shape, and have their base portions pivotally supported on the rocker shaft 8 and free ends extending above the intake valves 1*a*, 1*b*. Tappet screws 9*a*, 9*b* are movably threaded through the free ends of the rocker arms 5, 7 and are held against the upper ends of the intake valves 1*a*, 1*b*. The tappet screws 9*a*, 9*b* are locked against being loosened by means of lock nuts 10*a*, 10*b*, respectively.

The second rocker arm 6 is pivotally supported on the rocker shaft 8 between the fist and third rocker arms 5, 7. The second rocker arm 6 extends from the rocker shaft 8 toward an intermediate position between but short of the intake valves 1*a*, 1*b*. As better shown in FIG. 2, the second rocker arm 6 has a cam slipper 6*a* on its upper surface which is held in sliding contact with the high-speed cam 4. An arm 12 of a loading device 11 (described later in detail) has a free end held against the lower surface of the end of the second rocker arm 6.

The camshaft 2 is rotatably supported above the engine body. The low-speed cam 3 is integrally formed on the camshaft 2 in alignment with the first rocker arm 5, and the high-speed cam 4 is integrally formed on the camshaft 2 in alignment with the second rocker arm 6. The camshaft 2 also has an integral circular raised portion 2*a* in alignment with the third rocker arm 7, the raised portion 2*a* having a peripheral surface equal to the base circle of the cams 3, 4.

As better illustrated in FIG. 3, the low-speed cam 3 has a relatively small lift and a cam profile suitable for low-speed operation of the engine. The low-speed cam 3 has an outer peripheral surface held in sliding contact with a cam slipper 5*a* on the upper surface of the first rocker arm 5. The high-speed cam 4 is of a cam profile suitable for high-speed operation of the engine and has a larger lift and a wider angular extent than the low-speed cam 3. The high-speed cam 4 has an outer peripheral surface held in sliding contact with the cam slipper 6*a* of the second rocker arm 6. The raised portion 2*a* is held in sliding contact with an abutment surface 7*a* on the upper surface of the third rocker arm 7 for preventing the third rocker arm 7 from swinging undesirably during low-speed operation. The loading device 11 is omitted from illustration in FIG. 3 for clarity of illustration.

As shown in FIGS. 5 and 6, the first through third rocker arms 5 through 7 are switchable between a position in which they pivot together as a unit and a position in which they are relatively displaceable. This is accomplished by a coupling 13 (described later) mounted in holes defined centrally through the rocker arms 5 through 7 parallel to the rocker shaft 8.

The loading device 11 has an outer tube 15 pivotally supported on the cylinder head 14, the outer tube 15 having opposite ends angularly movable about its own axis. A torsion coil spring 16 is disposed around the outer tube 15 and has one end engaging the cylinder head 14 and the other end engaging the outer tube 15. The outer tube 15 is normally urged to be twisted clockwise in FIG. 2 under the bias of the torsion coil spring 16. An arm 12 extends integrally from a central portion of the outer tube 15 and is held against the lower surface of the free end of the second rocker arm 6. The second rocker arm 6 and the arm 12 are normally held in abutment against each other under the resiliency of the torsion coil spring 16.

A torsion bar spring 17 is inserted as an auxiliary spring means through the outer tube 15. The torsion bar spring 17 has serrations 18 on one end thereof by which the torsion bar spring 17 is fixed to the cylinder head 14 in a cantilevered fashion. The other free end of the torsion bar spring 17 is held in sliding contact with the inner peripheral surface of the outer tube 15 for angular displacement within a torsional resiliency range.

Figure 4:
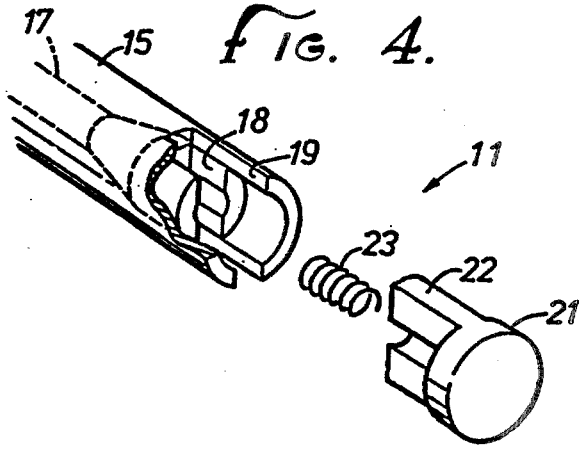
FIG. 4 is a fragmentary exploded perspective view, with portions broken away, of the loading device illustrated in FIG. 1.

As better shown in FIG. 4, the free end of the torsion bar spring 17 has a slit 18, and the corresponding end of the outer tube 15 has a slit 19 having the same width as that of the slit 18. The slits 18, 19 are aligned with each other in an angular range in which the base-circle portion 4*a* of the high-speed cam 4 is in sliding contact with the cam slipper 6*a* of the second rocker arm 6.

The cylinder head 14 which supports the slitted end of the outer tube 15 has a relatively short cylinder 20 concentric with the outer tube 15. A switching piston 21 is slidably disposed in the cylinder 20.

The switching piston 21 has on one end thereof an engaging portion 22 shaped complementarily to the slits 18, 19 of the outer tube 15 and the torsion bar spring 17. A compression coil spring 23 is disposed between the switching piston 21 and the end of the torsion bar spring 17 for normally urging the switching piston 21 to move away from the torsion bar spring 17 in the axial direction.

The engaging portion 22 is dimensioned and positioned such that it only engages in the slit 19 of the outer tube 15 when no external force is applied to the piston 21, and it will engage in the slits 18, 19 simultaneously when the piston 21 is pushed toward the torsion bar spring 17 against the bias of the compression coil spring 23. The piston 21 is operated by oil under pressure which is supplied from an oil pressure source (not shown) via a hydraulic passage 24 defined in the cylinder head 14.

Retainers 25*a*, 25*b* are disposed on the upper portions of the intake valves 1*a*, 1*b*, respectively. Valve springs 26*a*, 26*b* are interposed between the retainers 25*a*, 25*b* and the engine body and disposed around the stems of the intake valves 1*a*, 1*b* for normally urging the valves 1*a*, 1*b* in a closing direction, i.e., upwardly in FIGS. 2 and 3.

As shown in FIGS. 5 and 6, the first rocker arm 5 has a first guide hole 27 opening toward the second rocker arm 6 and extending parallel to the rocker shaft 8. The first rocker arm 5 also has a smaller-diameter hole 28 near the closed end of the first guide hole 27, with a step 29 being defined between the smaller-diameter hole 28 and the first guide hole 27.

The second rocker arm 6 has a second guide hole 30 communicating with the first guide hole 27 in the first rocker arm 5 and extending between the opposite sides thereof.

The third rocker arm 7 has a third guide hole 31 communicating with the second guide hole 30. The third rocker arm 7 also has a step 32 and a smaller-diameter hole 33 near the closed end of the third guide hole 31. The third rocker arm 7 also has a smaller-diameter hole 34 extending through the bottom of the third guide hole 31 concentrically therewith.

The first through third guide holes 27, 30, 31 accommodate therein a first piston 35 movable between a position in which the first and second rocker arms 5, 6 are interconnected and a position in which they are disconnected, a second piston 36 movable between a position in which the second and third rocker arms 6, 7 are interconnected and a position in which they are disconnected, a stopper 37 for limiting movement of the pistons 35, 36, a first coil spring 38 for urging the pistons 35, 36 toward the interconnecting positions, and a second coil spring 39 for urging the pistons 35, 36 toward the disconnecting positions, the second coil spring 39 having a stronger spring force than that of the first coil spring 38.

The first piston 35 is slidable in the first and second guide holes 37, 30, and defines a hydraulic pressure chamber 40 between the bottom of the first guide hole 27 and the end face of the first piston 35. The rocker shaft 8 has a hydraulic passage 41 defined therein and communicating with a hydraulic pressure supply device (not shown) for continuously communicating the passage 41 with the hydraulic pressure chamber 40 through a hydraulic passage 42 defined in the first rocker arm 5 in communication with the hydraulic pressure chamber 40 and a hole 43 defined in a peripheral wall of the rocker shaft 8, irrespective of the position to which the first rocker arm 5 is angularly moved.

The axial dimension of the first piston 35 is selected such that when one end thereof abuts against the step 29 in the first guide hole 27, the other end thereof does not project from the side surface of the first rocker arm 5 which faces the second rocker arm 6.

The axial dimension of the second piston 36 is equal to the overall length of the second guide hole 30 and is slidable in the second and third guide holes 30, 31.

The stopper 37 has on one end a circular plate 37*a* slidably fitted in the third guide hole 31 and also has on the other end a guide rod 44 extending through the smallerdiameter hole 34. The second coil spring 39 is disposed around the guide rod 44 between the circular plate 37*a* of the stopper 37 and the bottom of the smaller-diameter hole 33.

Operation of the above mechanism now will be described. In low- and medium-speed ranges of the engine, no hydraulic pressure is supplied to the hydraulic pressure chamber 40 of the coupling 13, and the pistons 35, 36 are disposed respectively in the guide holes 27, 30 under the biasing forces of the second coil spring 39 as shown in FIG. 6. Therefore, the rocker arms 5 through 7 are angularly movable relative to each other.

When the rocker arms are not interconnected by the coupling 13, the first rocker arm 5 is angularly moved in sliding contact with the low-speed cam 3 in response to rotation of the camshaft 2, and the opening timing of one of the intake valves 1*a* is delayed and the closing timing thereof is advanced, with the lift thereof being reduced. The third rocker arm 7 is not angularly moved since the raised portion 2a has a circular profile, and hence the other intake valve 1b remains closed. At this time, the second rocker arm 6 is angularly moved in sliding contact with the high-speed cam 4, but such angular movement does not affect operation of either of the intake valves 1a, 1b in any way. While the engine operates in the low- and medium-speed ranges, therefore, only the intake valve 1a is opened and closed for reducing fuel consumption and improving idling characteristics of the engine.

Similarly, for low- and medium-speed operation with only intake valve 1a being operated, no hydraulic pressure is applied to the switching piston 21 of the loading device 11. The engaging portion 22 of the piston 21 is held out of contact with the slit 18 of the torsion bar spring 17. Therefore, the outer tube 15 is only subjected to twisting forces from the torsion coil spring 16. Thus, the resilient force by arm 12 urging rocker arm 6 against cam 4 is relatively light during the low-and medium-speed range. Also, at this time, only the first rocker arm 5 is being driven, and the intake valve 1a is urged to be closed only by the valve spring 26a.

When the engine is to operate in a high-speed range, working oil pressure is supplied to the hydraulic pressure chamber 40 of the coupling 13. As shown in FIG. 5, the first piston 35 is moved into the second rocker arm 6 against the bias of the second coil spring 39, pushing the second piston 36 into the third rocker arm 7. As a result, the first and second pistons 35, 36 are moved together until the circular plate 37a of the stopper 37 engages the step 32, whereupon the first and second rocker arms 5, 6 are interconnected by the first piston 35 and the second and third rocker arms 6, 7 are interconnected by the second piston 36.

With the first through third rocker arms 5 through 7 being thus interconnected by the coupling 13, the first and third rocker arms 5, 7 are angularly moved in unison with the second rocker arm 6 since the extent of swinging movement of the second rocker arm 6 in sliding contact with the high-speed cam 4 is largest. Accordingly, the opening timing of the intake valves 1a, 1b is advanced and the closing timing thereof is delayed and the lift thereof is increased according to the cam profile of the high-speed cam 4.

In the low-speed range, the speeds of operation of the valves and the rocker arms are relatively low, and only the inertial masses of the first rocker arm 5 and the valve 1a are involved so that the biasing forces to close the valves may be comparatively small. An excessive increase in the biasing forces to close the valves would not be preferable since the friction would be increased. As the engine speed increases and the first through third rocker arms 5 through 7 are interconnected, however, the speeds of operation of the valves and the rocker arms are increased, and the inertial mass of the overall valve operating mechanism is also increased. As a consequence, the reactive forces of only the torsion coil spring 16 of the loading device 11 and the valve springs 26a, 26b are not large enough to close the intake valves 1a, 1b properly and simultaneously lift the first through third rocker arms 5 through 7.

When the engine speed becomes higher than a preset speed, the hydraulic passage 24 is brought into communication with the hydraulic pressure source by a solenoidoperated valve, for example, which is selectively opened by a speed signal. When hydraulic pressure is applied to the switching piston 21, the engaging portion 22 of the piston 21 engages in the slits 18, 19 of the outer tube 15 and the torsion bar spring 17. In the high-speed range, the outer tube 15 and the torsion bar spring 17 are angularly moved together. Therefore, in the high-speed range, an additional twisting force is applied to the arm 12 by the torsion bar spring 17, thereby increasing the force with which the cam slipper 6a of the second rocker arm 6 is pressed against the high-speed cam 4. The valve springs 26a, 26b are now required only to handle the inertial motion of the intake valves 1a, 1b during closing.

While in the above embodiment the switching piston 2 is hydraulically operated, it maybe actuated by an electromagnetic means. The switching timings of the loading device 11 and the coupling 13 may suitably be determined according to the characteristics of the engine.

Figure 7:
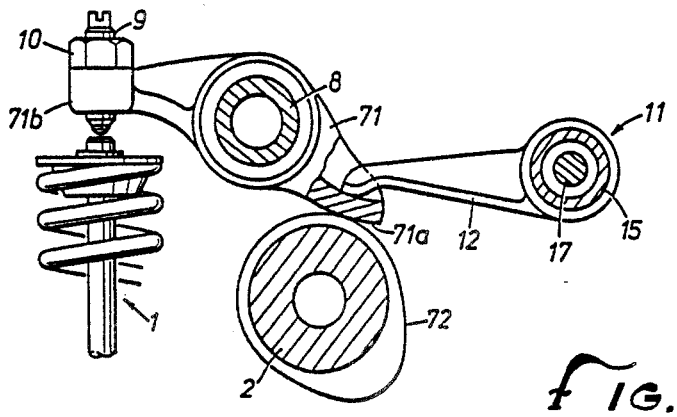
FIG. 7 is a fragmentary cross-sectional elevation view similar to FIGS. 2 and 3, showing a second embodiment of the valve operating mechanism.

FIG. 7 shows a second embodiment of the present invention. Those parts in FIG. 7 which are identical to those of the first embodiment are denoted by identical reference characters, and will not be described in detail. In this second embodiment, the rocker shaft 8 is positioned above the camshaft 2. A swingably movable rocker arm 71 has one end 71a held in sliding contact with the outer peripheral surface of a cam 72, and the other end 71b engaging the valve stem end of a valve 1 through a tappet screw 9. The arm 12 of the loading device 11 urges the end 71a of the rocker arm 71 to be pressed down against the cam surface of the cam 72. As with the first embodiment, when the speed of rotation of the engine exceeds a prescribed speed, an additional twisting force is applied by the torsion bar spring 17 to the rocker arm 71.

Figure 8:
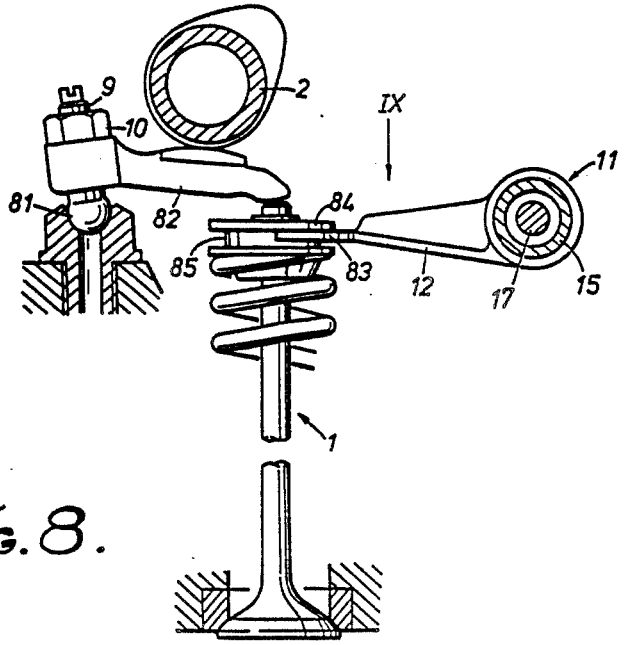
FIG. 8 is a cross-sectional elevation view similar to FIGS. 2, 3, and 7, illustrating a third embodiment of the valve operating mechanism.
Figure 9:
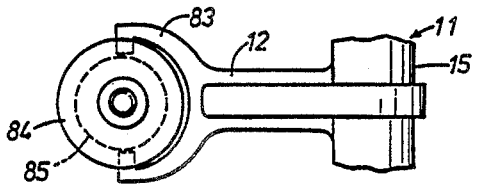
FIG. 9 is a plan view in the direction of the arrow IX shown in FIG. 8.

FIGS. 8 and 9 illustrate a third embodiment in which a valve 1 is opened through a swing arm 82 type of cam follower supported by a ball joint 81. The arm 12 of the loading device 11 has a bifurcated or forked free end 83 engaging an annular groove 85 defined in the outer peripheral surface of a spring retainer 84 secured to the stem end of the valve 1. By this arrangement, an additional force can be applied directly to the valve 1 for closing the valve and urging the cam follower against the cam irrespective of the type of swing arm or rocker arm, and therefore the spring force of the valve spring can be varied between two stages by selective operation of the loading device 11.

Figure 10:
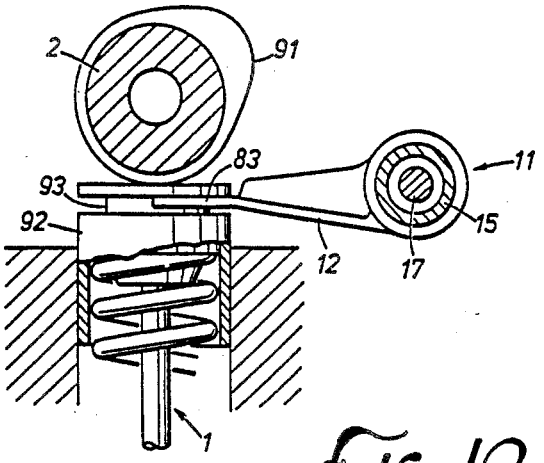
FIG. 10 is a cross-sectional elevation view similar to FIGS. 2, 3, 7, and 8, illustrating a fourth embodiment.

FIG. 10 shows a fourth embodiment incorporated in a direct lifter type valve operating mechanism in which the valve 1 is driven directly by a cam 91. The loading device 11 of the fourth embodiment is the same as the third embodiment except that the bifurcated or forked free end 83 of the arm 12 engages in an annular groove 93 defined in the cylindrical surface of a piston-like follower 92.

While the torsion bar spring is employed as the auxiliary spring means in each of the above embodiments, the present invention is not limited to such spring, but it is possible to utilize the resiliency of the arm itself.

With the present invention, as described above with respect to the embodiments of FIGS. 1–10, the biasing forces of only the valve springs act on the valves and only the coil spring acts on the cam follower in the low- and medium-speed ranges, and the biasing force of the auxiliary spring means such as the torsion bar spring, for example, is also applied to the valve operating mechanism in the high-speed range. Therefore, the spring constants of the valve springs may be relatively low.

Since fuel consumption can be reduced in the low- and medium-speed ranges and the ability of the valve operating mechanism to follow the cams is increased in the high-speed range, these embodiments of the present invention is highly advantageous in improving the operating characteristics of the engine in a wider range.

Figure 11:
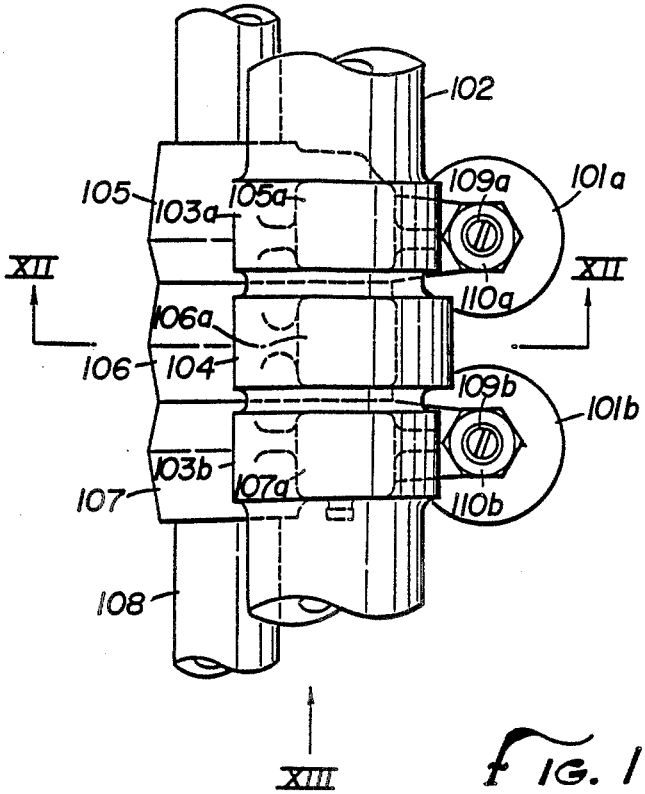
FIG. 11 is a plan view similar to FIG. 1 of a fifth embodiment of the valve operating mechanism with a loading device of the present invention.

Referring now to FIGS. 11–19, additional embodiments of the present invention are shown which employ somewhat different components for accomplishing a similar variation in the biasing forces imposed on the valve springs and cam followers. As shown in FIG. 11, an engine body (not shown) has a pair of intake valves 101*a*, 101*b* which can be opened and closed by the coaction of a pair of low-speed cams 103*a*, 103*b* and a single high-speed cam 104 which are of an appropriate shape and are integrally formed on a camshaft 2 synchronously rotatable at a speed ratio of ½ with respect to the speed of rotation of a crankshaft (not shown), with first through third rocker arms 105 through 107 serving as cam followers swingable in engagement with the cams 103*a*, 103*b* and 104. The engine also has a pair of exhaust valves (not shown) which are opened and closed in the same manner as the intake valves.

As with the first embodiment, the first through third rocker arms 105 through 107 are pivotally supported adjacent to each other on a rocker shaft 108 located below the camshaft 102 and extending parallel thereto. The first and third rocker arms 105, 107 are basically of the same shape, and have their base portions pivotally supported on the rocker shaft 108 and free ends extending above the intake valves 101*a*, 101*b*. Tappet screws 109*a*, 109*b* are movably threaded through the free ends of the rocker arms 105, 107 and are held against the upper ends of the intake valves 101*a*, 101*b*. The tappet screws 109*a*, 109*b* are locked against being loosened by means of lock nuts 110*a*, 110*b*, respectively.

The second rocker arm 106 is pivotally supported on the rocker shaft 108 between the first and third rocker arms 105, 107. The second rocker arm 106 extends from the rocker shaft 108 toward an intermediate position between but short of the intake valves 101*a*, 101*b*. As better shown in FIG. 12, the second rocker arm 106 has a cam slipper 106*a* on its upper surface which is held in sliding contact with the high-speed cam 4. An arm 112 of a loading device 111 (described later in detail) has an upper end held against the lower surface of the end of the second rocker arm 106.

The camshaft 102 has low-speed cams 103*a*, 103*b* integrally formed thereon in alignment with the first and third rocker arms 105, 107 and a high-speed cam 104 integrally formed thereon in alignment with the second rocker arm 106. As better illustrated in FIG. 13, the low-speed cams 103*a*, 103*b* have a relatively small lift and a cam profile suitable for low-speed operation of the engine. The low-speed cams 103*a*, 103*b* have outer peripheral surfaces held in sliding contact with cam slippers 105*a*, 107*a*, respectively, on the upper surfaces of the first and third rocker arms 105, 107. The high-speed cam 104 is of a cam profile suitable for highspeed operation of the engine and has a larger lift and a wider angular extent than the low-speed cams 103*a*, 103*b*. The high-speed cam 104 has an outer peripheral surface held in sliding contact with the cam slipper 106*a* of the second rocker arm 106. The loading device 111 is omitted from illustration in FIG. 13 for clarity.

The first through third rocker arms 105 through 107 are switchable between a position in which they pivot together and a position in which they are relatively displaceable by a coupling (unnumbered) of the same type described with respect to the first embodiment and shown in FIGS. 5 and 6, which description will not be repeated here.

As illustrated in FIG. 12, the loading device 111 comprises a guide hole 115 defined in a cylinder head 114 substantially parallel to the axes along which the intake valves 101*a*, 101*b* (not shown in FIG. 12) are slidable, a lifter 112 slidably fitted in the guide hole 115, a coil spring 116 for normally urging the lifter 112 upwardly and a piston 117 held between the lower end of the coil spring 116 and the bottom of a larger-diameter portion 115*a* of the guide hole 115. The piston 117 is slidably fitted in the larger-diameter portion 115*a* in a fluid-tight manner. The piston 117 is movable upwardly along the inner peripheral surface of the larger-diameter portion 115*a* under hydraulic pressure supplied from a non-illustrated hydraulic pressure source via a hydraulic passage 119 and a hydraulic port 118 defined in the bottom of the guide hole 115.

Retainers 125*a*, 125*b* are disposed on the upper portions of the intake valves 101*a*, 101*b*, respectively. Valve springs 126*a*, 126*b* are interposed between the retainers 125*a*, 125*b* and the engine body and disposed around the stems of the intake valves 101*a*, 101*b* for normally urging the valves in a closing direction, i.e, upwardly in FIG. 13.

The operation of the above mechanism of FIGS. 11–13 now will be described. In low- and medium-speed ranges of the engine, the coupling (coupling 13 in FIGS. 5 and 6) is not actuated and therefore the rocker arms 105, 106, 107 are angularly movable relative to each other. When the rocker arms are disconnected, the first and third rocker arms 105,107 are moved in sliding contact with the low-speed cams 103*a*, 103*b* in response to rotation of the camshaft 102, and the opening timing of the intake valves 101*a*, 101*b* is delayed and the closing timing thereof is advanced, with the lift thereof being reduced. At this time, the second rocker arm 106 is angularly moved in sliding contact with the high-speed cam 104, but such angular movement does not affect operation of the intake valves 101*a*, 101*b* in any way. Also, no hydraulic pressure is applied to the piston 117 of the loading device 111. Since the initial amount of flexing of the compression coil spring 116 disposed under compression in the guide hole 115 is relatively small, the friction between the second rocker arm 106 and the high-speed cam 104 is very small range although the second rocker arm 106 is urged against the high-speed cam 4 at all times (FIG. 12).

When the engine is to operate in a high-speed range, working oil pressure is supplied to the coupling to interconnect the rocker arms 105, 106, 107 as previously described with respect to coupling 13 in the first embodiment. With the first through third rocker arms 105, 106, 107 being thus interconnected by the coupling to move in unison, all of the rocker arms are angularly moved with the second rocker arm 106 since the extent of swinging movement of the second rocker arm 106 in sliding contact with the high-speed cam 104 is largest. Accordingly, the opening timing of the intake valves 101*a*, 101*b* is advanced and the closing timing thereof is delayed and the lift thereof is increased according to the cam profile of the high-speed cam 104.

In the low-speed range, the speeds of operation of the valves and the rocker arms are relatively low, so that the biasing forces to close the valves may be comparatively small. As the engine speed increases and the first through third rocker arms 105 through 107 are interconnected, however, the speeds of operation of the valves and the rocker arms are increased, and the inertial mass of the overall valve operating mechanism is also increased. As a consequence, it is necessary in the high-speed range to increase the forces tending to close the intake valves 101*a*, 101*b* and lift the rocker arms toward the cams. According to this embodiment of the present invention, when the engine speed becomes higher than a preset speed, the hydraulic passage 119 is brought into communication with the hydraulic pressure source by a solenoid-operated directional control valve, for example, which is selectively opened by a speed signal. Upon introduction of oil under pressure from the port 118, the piston 117 is moved upwardly into abutment against a step 115*b* defined by the larger-diameter portion 115*a*. At this time, the coil spring 116 is compressed, thereby increasing the upward biasing force against the second rocker arm 106.

FIG. 14 shows the control timing and how the surface pressure between the cams and the cam slipper varies in this embodiment. If the valve springs 126*a*, 126*b* were set to spring constants appropriate for the entire speed ranges and only the valve timing were changed at a prescribed rotational speed N1, the surface pressure in the low-speed range would be relatively high as indicated by the broken line in FIG. 14, causing an increase in the friction. Normally, the cam surface pressure is reduced as the speed increases. However, when the valve lift is increased by changing the valve timing, the cam surface pressure is abruptly increased. Since the maximum surface pressure P1 at this time acts on the high-speed cam 104 and the second rocker arm 106, the area in which the cam and the cam slipper contact each other would need to be relatively large. However, with the present invention, the surface pressure between the cam and cam follower is reduced for all speed ranges, as shown by solid lines in FIG. 14.

The spring constants of the valve springs 101*a*, 101*b* are selected to be relatively low to meet only the low- and medium-speed ranges, for thereby reducing the cam surface pressure in the low-speed range. Therefore, the maximum surface pressure P2 in FIG. 14 when the valve timing is changed at the first engine rotational speed N1 is also held relatively low. When a biasing force against the second rocker arm 106 is added by the loading device 111 at the second engine rotational speed N2, the cam surface pressure is increased again, but such an increase is kept at a low level as compared with that at the time of changing the valve timing (N1).

FIG. 15 shows an embodiment which is a modification of the embodiment of FIGS. 11–13 described above. In this embodiment, the hydraulic pressure applied to the piston 117 in the first embodiment is replaced with pneumatic pressure applied to the lifter 112 from the bottom of the guide hole 115 via a passage 120. Because the applied pneumatic pressure functions as a spring, the spring constant can suitably be varied by changing the pressure of compressed air.

Figure 16:
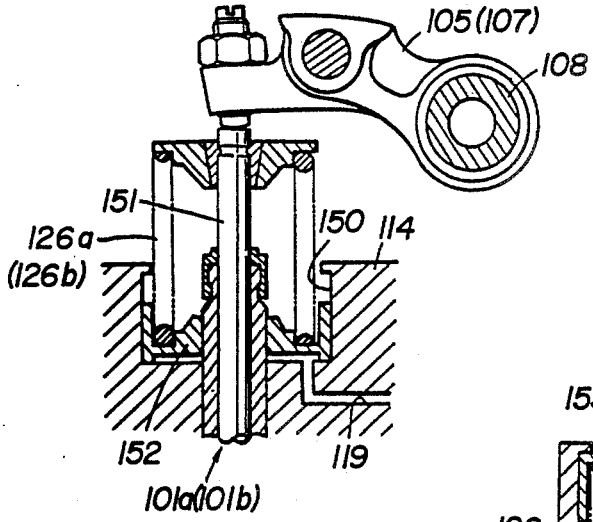
FIGS. 16, 17 and 18 are sectional elevation views similar to FIGS. 12 and 15 and illustrating other embodiments of the valve loading device of the present invention.

FIG. 16 illustrates another embodiment of the present invention, wherein a cylinder 150 is defined in a portion of the cylinder head 114 which holds the valve spring, and a spring seat 152 is disposed between the bottom of the cylinder 150 and the lower end of the valve spring 126*a*, (126*b*) around a valve stem 151. The spring seat 152 is slidable along the axis of the valve stem 151. The spring seat 152 is slidable along the axis of the valve stem 151. Hydraulic pressure is imposed on the lower surface of the spring seat 152 through a hydraulic passage 111 defined in the cylinder head 114 for varying the initial amount of flexing of the valve spring 126*a* (126*b*). The same control as that of the loading device of the embodiment of FIGS. 11–13 is carried out for varying the biasing forces to close the intake valve 101*a*, (101*b*).

Figure 17:
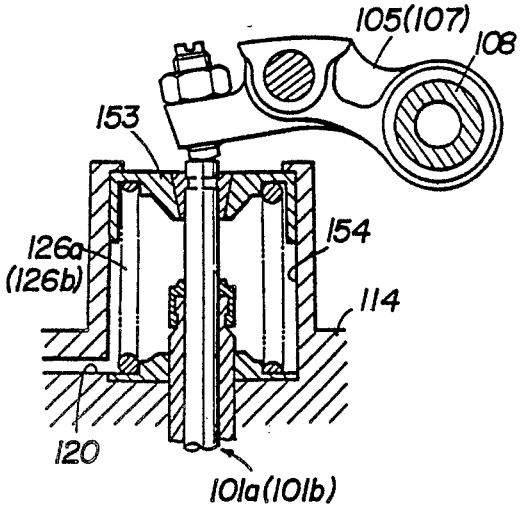

FIG. 17 shows still another embodiment in which an upper valve retainer 153 is in the form of a piston slidable against an inner cylindrical surface 154 on the cylinder head 114. Pneumatic pressure is applied to the inner surface of the valve spring retainer 153 through a passage 120 defined in the cylinder head 114 for adding the reactive force of compressed air to the valve spring 126*a* (126*b*) comprising a coil spring, as with the embodiment of FIG. 15.

Figure 18:
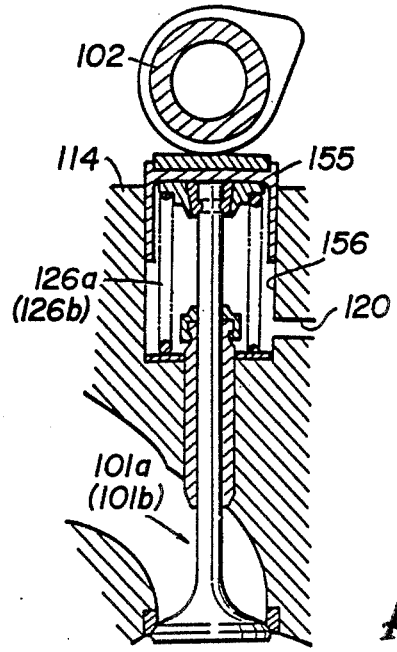
Figure 23:
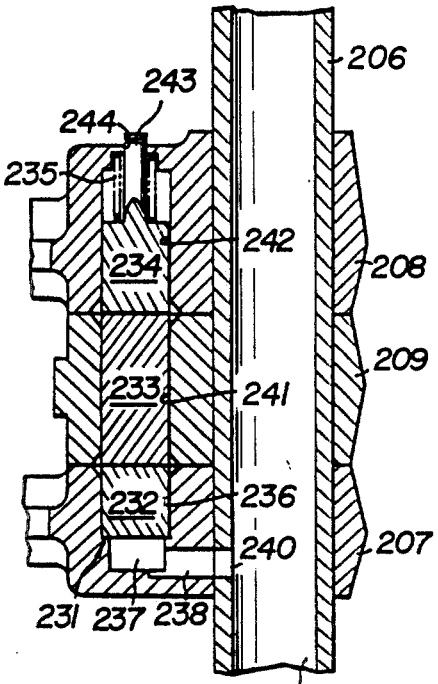
FIG. 23 is a sectional plan view taken substantially along the line XXIII—XXIII in FIG. 20.

FIG. 18 illustrates a further embodiment in which pneumatic pressure is applied to the inner surface of a piston-shaped direct lifter 155 through a passage 120 defined in a lower portion of a lift guide 156 for allowing direct driving by the camshaft 102. The same advantages as those of the embodiment of FIG. 17 described above can be obtained in this embodiment.

The embodiments of FIGS. 11–18 of the present invention are applicable not only to an engine having a plurality of intake valves per engine cylinder, as described, but also to an engine having a single intake valve per engine cylinder. The invention can be combined with a valve disabling mechanism as well as the variable valve timing mechanism. More specifically, the biasing force of a valve spring for a valve which operates at all times is set to a weak level when the other valve is at rest or disabled, and is set to a strong level when both of the valves are operated. The rotational speed at which the valve timing is to be changed, and the rotational speed at which the valve spring load is to be changed may appropriately be determined according to operating characteristics of the engine.

Referring now to the related embodiments of FIGS. 19–25, again there are somewhat different components employed for accomplishing a similar variation in the biasing forces imposed on the valves and the operating mechanism than those components shown and described with respect to the previous embodiments of FIGS. 1–18. The basic arrangement and operation of the valves, rocker arms, camshaft and cams are the same and their operation will not be repeated in detail here. Again, rocker arms 207, 208, 209 are pivotally mounted on rocker shaft 206 to be engaged by cams 203, 205, 203*a* with rocker arms 207 and 208 engaging the valves 201*a* and 201*b*. By selectively interconnecting or disconnecting the rocker arms 207, 208, 209 by the coupling mechanism including the coupling pins 232, 233, 234, the rocker arms pivot in unison or independently. Tappet adjusting screws 212, 213 are provided on rocker arms 207 and 208 for adjustable engagement with the ends of the valves 201*a* and 201*b*. Flanges 214, 215 are attached to the upper ends of the intake valves 201*a*, 201*b* for being engaged by the valve springs encircling the valves and extending between the flanges and the cylinder head of the engine E.

In the embodiments of FIGS. 19–25, the valve springs are of a different design than the conventional valve springs 26*a*, 26*b*, 126*a*, 126*b* previously described. In the embodiment of FIG. 20, the valve springs 216, 217 are provided with coils that have a non-uniform pitch p that is progressively larger from both ends toward the center of the spring. The loading characteristic curve of such a non-uniform-pitch coil spring is indicated by the solid line in FIG. 21, as compared to the straight dashed line representing a conventional coil spring. As the displacement of the valve spring in a valve opening direction is increased, i.e., the amount of compression of the valve spring is increased, the spring load increases. The rate of change of such spring load is larger as the amount of compression becomes larger. More specifically, while a uniform-pitch coil spring has a linear loading characteristic curve as shown by the straight dashed line in FIG. 21, each of the valve springs 216, 217 which is a non-uniform-pitch coil spring has a nonlinear loading characteristic curve.

In addition to the spring biased load provided by the springs 216 and 217 on the valves, a cylinder lifter 219 is positioned to about the lower surface of the third rocker arm 209 and a lifter spring 220 resiliently urges the third rocker arm 209 into engagement with the high-speed cam 205, whereby the force of spring 220 is the only engaging force between the rocker arm 209 and cam 205 during low speed operation.

During high speed operation, the rocker arms 207, 208, 209 are interconnected and move in unison whereby the return force on the valves and the rocker ar 209 toward engagement with the high-speed cam 205 is a combination of the valve springs 216, 217 and the lifter spring 20.

During opening and closing of the valves 201*a*, 201*b*, the resilient closing force imposed by the valve springs 216, 217 varies relative to the amount of compression. As shown in FIG. 21, the amount of compression and load of the valve spring 216, 217 when the first and second rocker arms 207, 208 are in sliding contact with the base circles 203*b* of the low-speed cams 3 are indicated by 0, P0, respectively. The amount of compression and spring load become 01 and P1, respectively, during the low-speed operation when the rocker arms 7, 8 are in engagement with the cam lobe 3*a*. The compression and spring load become 02 and P2, respectively, during the high-speed operation when the rocker arm 209 engages the high-speed cam lobe 205*a*. If conventional valve springs having linear loading characteristics were employed, the spring load during the low-speed operation would become P1' provided the spring load during the high-speed operation is also P2. Therefore, with a conventional spring, the spring load at low-speed operation is larger than the spring load P1 of the non-uniform-pitch coil springs of this invention.

Stated otherwise, the spring load of the valve springs 216, 217 may be relatively small during the low-speed operation, for thereby reducing the frictional loss between the low-speed cams 203, 203 and the first and second rocker arms 207, 208. Because the pressure on the cam surfaces is also lowered, the width of the cam slippers 210, 211 may also be reduced.

Figure 24:
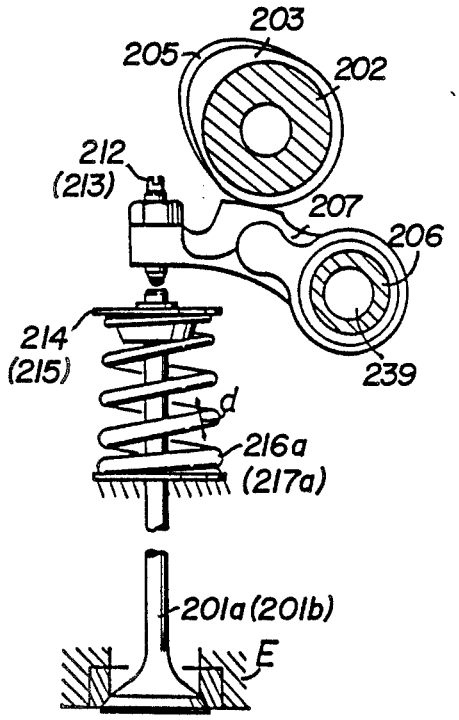
FIGS. 24 and 25 are sectional elevation views similar to FIG. 20 and showing different embodiments of this form of the present invention.
Figure 25:
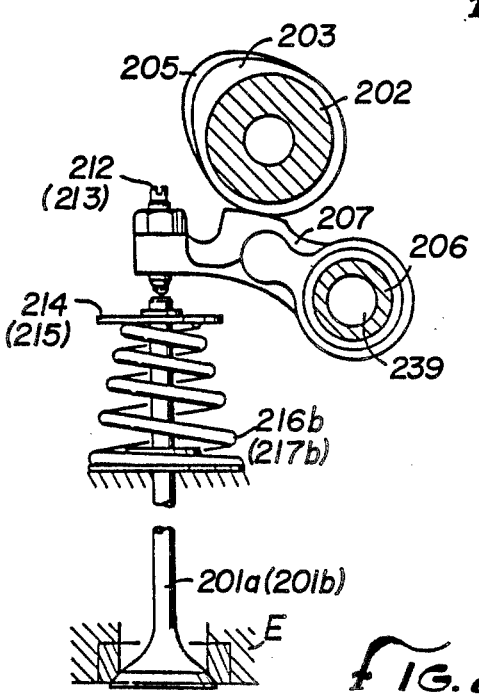

FIG. 24 shows another embodiment of the invention in which most of the parts are identical to those of the preceding embodiment. Valve springs 216*a*, 217*a* disposed between the intake valves 201*a*, 201*b* and the engine body E comprise tapered coil springs with the diameter d of the spring wire thereof varying in the longitudinal direction of the spring. As a result, this embodiment has the same advantages as the preceding embodiment. As another embodiment, a conical coil spring may be employed for each of the valve springs 216*b*, 217*b*, as shown in FIG. 25. As still another embodiment, a valve spring may comprise a plurality of coil springs coupled in series, or end to end, the coil springs having different spring constants.

With the embodiments of FIGS. 19–25 of the present invention, as described above, a valve spring has non-linear loading characteristics in which the rate of change of the spring load is increased as the amount of displacement of the valve spring is increased in a direction to open a valve. Therefore, the spring load of the valve spring may be smaller during low-speed operation of an engine than that of a conventional spring having linear loading characteristics, with the result that the frictional loss can be lowered, and yet the spring load during high-speed operation at the full open position of the valve will be the same as a conventional spring.

We claim:

1. A valve operating mechanism for an internal combustion engine having a valve disposed in an intake port or an exhaust port of a combustion chamber, comprising:

rotatably mounted cam means operable to move said valve in the opening direction;

means for selectively operably connecting said cam means to said valve for varying the mode of operation thereof whereby said valve is opened to a different extent according to variable engine operating conditions;

a coil type valve spring encircling said valve and resiliently urging said valve toward the closed position, said valve spring having non-linear loading characteristics to impose on said valve a biasing force generated at a first spring load when said valve is opened to one extent in one mode of operation and a biasing force generated at a second spring load when said valve is opened to another extent in a second mode of operation.

2. The valve operating mechanism of claim 1 wherein, in said second mode of operation, said valve is opened to a greater extent than in said first mode of operation and said valve spring effects an increase in biasing force on said valve generated at an increased spring load, as compared with the biasing force imposed on said valve during said first mode of operation.

3. A valve operating mechanism for an internal combustion engine having an intake or an exhaust valve operatively coupled to at least one of a plurality of cam followers operable in response to rotation of a camshaft, a valve spring interposed between said intake or exhaust valve and an engine body, and a selective coupling mechanism disposed between the cam followers for selectively connecting and disconnecting the cam followers with respect to each other, said valve spring having non-linear loading characteristics in which said spring imposes a force on said valve at one spring load when it is opened by said cam followers in disconnected relation and another force on said valve at a different spring load when it is opened by said cam followers in connected relation.

4. The valve operating mechanism of claim 3 wherein, with said cam followers in connected relation, said valve is opened to a greater extent and said spring force on said valve is increased to an extent determined by an increased spring load as compared with the biasing force imposed on said valve when said cam followers are in disconnected relation.

5. The valve operating mechanism of claim 1, wherein said valve spring has coils of a varying pitch with the coils at the ends of the valve spring having a smaller pitch than coils in the center of the valve spring.

6. The valve operating mechanism of claim 1, wherein the valve spring is conical with coils of a larger diameter at one end than at the other.

7. The valve operating mechanism of claim 1, wherein the valve spring is formed of a spring wire having a varying diameter, with the coils at one end being formed of a large diameter wire and the wire diameter decreasing toward the other end.

8. The valve operating mechanism of claim 3, wherein said valve spring is a coil type and has coils of a varying pitch.

9. The valve operating mechanism of claim 3, wherein said valve spring is a coil type and has coils of a varying diameter to form a conically shaped coil spring.

10. The valve mechanism of claim 3, wherein the valve spring is a coiled wire type and the diameter of the coiled wire decreases from one end of the coil to the other.

* * * * *